United States Patent [19]

Yoshida

[11] 4,251,912

[45] Feb. 24, 1981

[54] APPARATUS FOR PRODUCING A COUPLING ELEMENT ASSEMBLY FOR SLIDE FASTENERS

[75] Inventor: Hiroshi Yoshida, Kurobe, Japan

[73] Assignee: Yoshida Kogyo K.K., Tokyo, Japan

[21] Appl. No.: 41,328

[22] Filed: May 22, 1979

[30] Foreign Application Priority Data

Jun. 9, 1978 [JP] Japan ..... 53-69426

[51] Int. Cl.[3] ..... B29D 5/00

[52] U.S. Cl. ..... 29/766; 226/77; 226/87; 425/545; 425/814

[58] Field of Search ..... 29/408, 410, 766, 769; 226/77, 87; 425/117, 121, 122, 123, 126 R, 129 R, 545, 814

[56] References Cited

U.S. PATENT DOCUMENTS

| | | | |
|---|---|---|---|
| 3,197,575 | 7/1965 | Eckstein | 226/87 X |
| 3,445,915 | 5/1969 | Cuckson et al. | 29/408 |
| 3,836,413 | 9/1974 | Frohlich et al. | 29/769 X |
| 4,033,014 | 7/1977 | Manning | 24/205.16 R |
| 4,115,489 | 9/1978 | Macfee | 425/814 X |
| 4,137,034 | 1/1979 | Moertel | 425/814 X |
| 4,158,532 | 6/1979 | Kowalski | 425/814 X |
| 4,175,104 | 11/1979 | Moertel | 425/814 X |
| 4,182,600 | 1/1980 | Moertel | 425/814 X |

*Primary Examiner*—Ervin M. Combs

*Attorney, Agent, or Firm*—Robert E. Burns; Emmanuel J. Lobato; Bruce L. Adams

[57] ABSTRACT

A warp-knit elongate structure is provided which has a pair of spaced warp-knit elongate webs and a plurality of transverse thread portions spaced longitudinally of and interconnecting the warp-knit elongate webs. The shape of the warp-knit structure is corrected into a ladder-like structure and then is introduced into an elongate mold cavity, in which synthetic resin is molded around the portion of the warp-knit webs and the transverse thread portion which are disposed in the mold cavity. A molded product that constitutes a portion of a coupling element assembly is separated from the mold cavity, and is bent about its transverse central axis into the shape of a U. A guide drum is disposed adjacent to a molding wheel for guiding the warp-knit structure onto the molding wheel and for rectifying the shape of the warp-knit structure into a ladder-like structure.

2 Claims, 16 Drawing Figures

APPARATUS FOR PRODUCING A COUPLING ELEMENT ASSEMBLY FOR SLIDE FASTENERS

BACKGROUND OF THE INVENTION

1. Field of the Invention

The present invention relates to zippers or slide fasteners and more particularly to a method and an apparatus for producing a coupling element assembly for slide fasteners.

2. Prior Art

U.S. Pat. Nos. 3,445,915 and 4,033,014 exemplify the prior art in the field of methods and apparatus for producing a coupling element assembly for slide fasteners which includes a row of spaced coupling elements of synthetic resin and a plurality of connecting threads having their portions embedded in the coupling elements to interconnect the spaced coupling elements. The known methods and apparatus, however, are not suitable for manufacturing coupling element assemblies having coupling elements securely fastened to connecting threads and, at the same time, laterally shiftable just enough for smooth engagement and disengagement between an opposed pair of rows of coupling elements.

SUMMARY OF THE INVENTION

It is an object of the present invention to provide a method and an apparatus for producing a coupling element assembly for slide fasteners which has a row of spaced coupling elements anchored on coupling-element connecting means against any accidental displacement.

Another object of the present invention is to provide a method and an apparatus for producing a coupling element assembly for slide fasteners which has coupling-element connecting means stretchable just enough for smooth engagement and disengagement between a companion pair of rows of coupling elements.

Still another object of the present invention is to provide a method and an apparatus for mass-producing coupling element assembly for slide fasteners inexpensively.

According to a method of the present invention, a warp-knit elongate structure for interconnecting a row of spaced coupling elements is provided and correcting in shape into a predetermined ladder-like configuration having a pair of parallel warp-knit elongate webs laterally spaced from each other and a plurality of transverse thread portions interconnecting the warp-knit webs and spaced from each other longitudinally of the elongate webs. The warp-knit elongate structure thus shaped is then fed into mold cavities in which synthetic resin is molded around the structure, thereby forming a molded coupling element assembly, which is cooled, separated from the mold cavities, and finally bent about its longitudinal axis into the shape of a U.

An apparatus according to the present invention includes a guide drum rotatably disposed adjacent to a molding wheel for guiding a ladder-like warp-knit elongate structure onto the molding wheel. The guide drum has on its periphery a plurality of substantially rectangular raised portions spaced circumferentially from each other with channels therebetween spaced from each other by a distance which is equal to a distance at which the mold cavities on the molding wheel are spaced from each other. Each of the rectangular raised portions has a width which is substantially the same as said distance between the longitudinal axes of adjacent mold cavities, and a length which is substantially the same as a distance between a pair of annular grooves intersecting the end portions of the mold cavities on the molding wheel. A cooling device is disposed between an injection shoe positioned for slidable contact with a portion of the periphery of the molding wheel and means disposed adjacent to the molding wheel for separating a molded coupling element assembly from the mold cavities. Means for bending the molded coupling element assembly about its longitudinal axis into the shape of a U is provided downstream of the separating means.

BRIEF DESCRIPTION OF THE DRAWINGS

The above and other objects, advantages and features of the present invention will become apparent from the following description of the preferred embodiments taken in conjunction with the accompanying drawings, in which.

DESCRIPTION OF THE PREFERRED EMBODIMENTS

Figure 1:
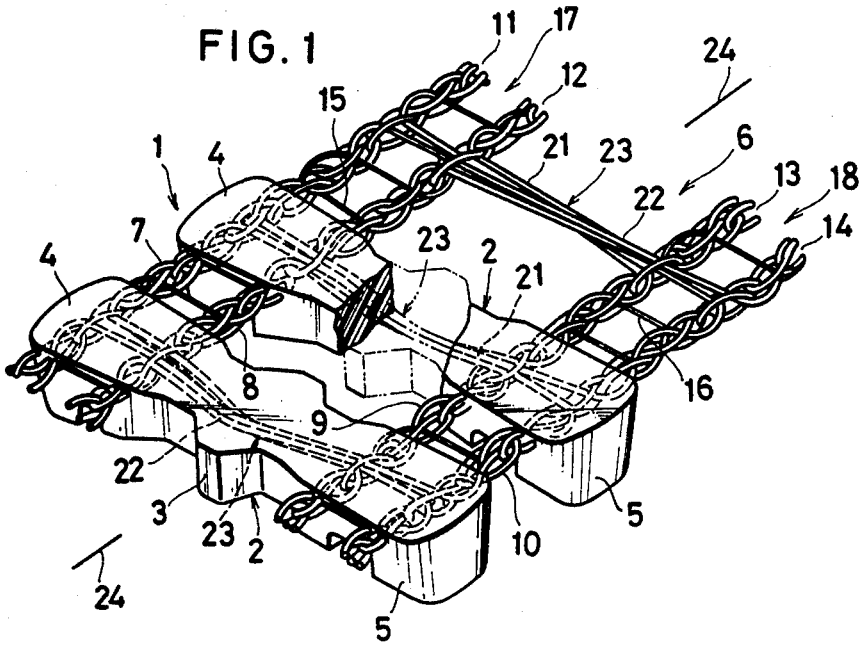
FIG. 1 is an enlarged fragmentary perspective view of a coupling element assembly produced by a method and an apparatus of the invention.

In FIG. 1, a coupling element assembly 1 as it is spread before being bent into the shape of a U includes a row of laterally spaced coupling elements 2 of synthetic resin, each having a coupling head portion 3 and a pair of leg portions 4,5 extending from the coupling head portion 3, and a warp-knit elongate, ladder-like structure 6 extending transversely of the laterally spaced coupling elements 2 having longitudinal portions embedded in the coupling elements 2.

The warp-knit elongate structure 6 comprises a group of first threads 7,8,9 and 10 forming a plurality of wales 11,12,13 and 14 of chain stitches, respectively, and a pair of second threads 15,16 interlaced with the wales 11,12 and with the wales 13,14, respectively, thereby providing a pair of warp-knit elongate webs 17,18. the warp-knit elongate structure 6 further includes a pair of sets of third threads 21,22 interlaced or interknitted with the wales 11,12,13 and 14 in opposite symmetrical patterns.

The warp-knit elongate webs 17,18 have longitudinal portions extending through and embedded in the leg portions 4,5 of each of the coupling elements 2. The pair of sets of third threads 21,22 have a plurality of parallel portions 23 spaced longitudinally on the first threads 7,8,9 and 10 and extending transversely of the wales 11,12,13 and 14. The parallel spaced portions 23 are embedded longitudinally in the coupling elements 2 and extend substantially the full length of the coupling elements 2.

Thus, prior to being bent into a U shape ready for attachment to a stringer tape, the coupling element 1 has a ladder-like structure. Each of the warp-knit webs 17,18 also has a ladder-like structure which is composed of the wales 11,12 or 13,14 interconnected by the second thread 15 or 16. With such a ladder-like structure of the webs 17,18, the leg portions 4,5 of the coupling elements 2 are fastened to the webs 17,18 with an increased degree of bonding strength. The warp-knit webs 17,18 allow material of the coupling elements 2 to enter into their interstices, and have a roughened surface engaging the coupling elements 2, so that the coupling elements 2 can be anchored in place on the webs 17,18.

The embedded parallel spaced portions 23 stabilize the coupling elements 2 positionally against any displacement particularly in the transverse direction thereof. This reinforcing arrangement is advantageous especially where the coupling elements 2 are made of an unstretched plastic material that is easily deformable, ductile, and soft. The portions of the wales 11,12,13 and 14 which are positioned between the coupling elements 2 are longitudinally stretchable sufficiently for smooth engagement and disengagement between a pair of companion rows of coupling elements.

The coupling element assembly 1 shown in FIG. 1 is folded over on itself about a longitudinal axis 24 before the assembly is mounted on a slide fastener stringer tape.

Figure 2:
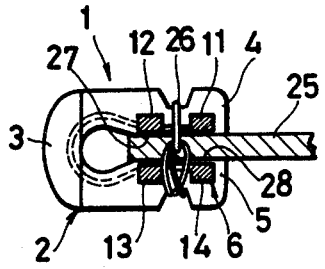
FIG. 2 is an end elevation view of the coupling element assembly as attached to a stringer tape.
Figure 3:
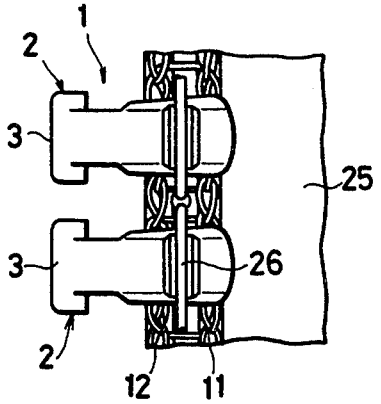
FIG. 3 is a plan view of the coupling element assembly shown in FIG. 2.

As shown in FIGS. 2 and 3, the coupling element assembly 1, when folded, has a substantially U-shaped cross section and is attached astride a longitudinal marginal edge portion of a slide fastener stringer tape 25 by means of threads with sewing stitches 26.

The coupling elements 2 may be bonded at their opposed surfaces 27,28 to the stringer tape 25 by welding or adhesive bonding. As an alternative, the warp-knit webs 17,18 may be woven or knit into a woven or knit fabric stringer tape.

Figure 4:
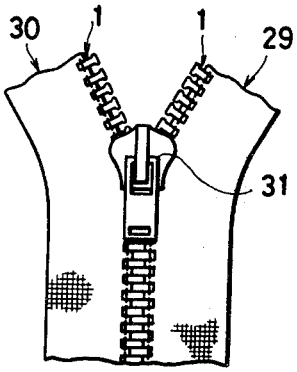
FIG. 4 is a plan view of a slide fastener having a pair of the coupling element assemblies.

FIG. 4 shows a pair of slide fastener stringers 29,30 having a pair of the coupling element assemblies 1, respectively, partly intermeshed by a slider 31 movable therealong.

Figure 5:
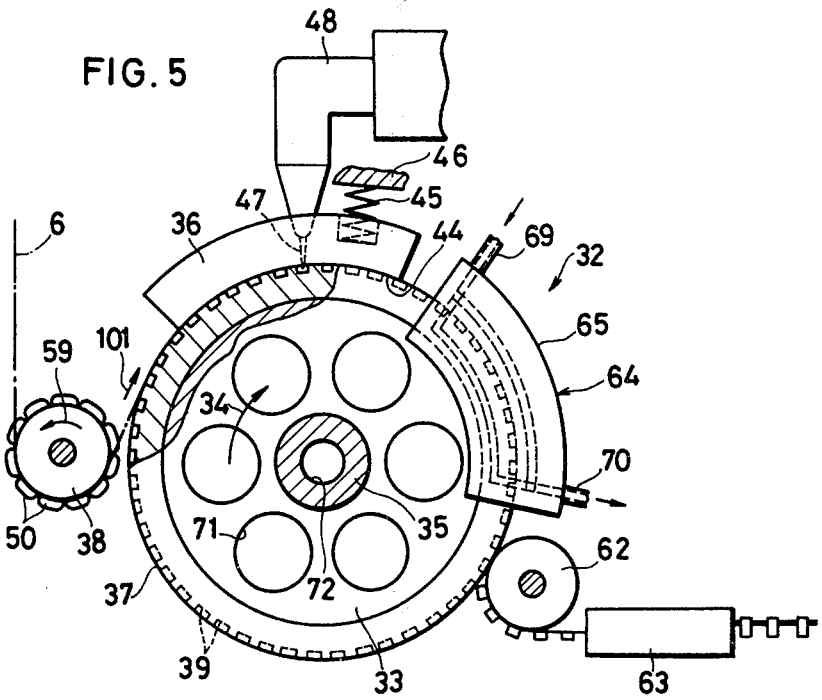
FIG. 5 is a schematic side elevation view of an apparatus according to the present invention.

An apparatus according to the present invention for producing the coupling element assembly 1 is shown in FIG. 5, generally indicated by 32. The apparatus 32 basically comprises a molding wheel 33 rotatably supported on a frame (not shown) and drivable by a suitable motor to revolve in the direction of the arrow 34 about an axle 35, and an injection shoe 36 disposed adjacent to the molding wheel 33 in slidable contact with a portion of the periphery 37 of the molding wheel 33.

The apparatus 32 additionally includes a guide drum 38 disposed adjacent to the molding wheel 33 upstream of the injection shoe 36 with respect to the direction 34 of rotation of the molding wheel 33.

The molding wheel 33 has on its periphery 37 a plurality of elongate mold cavities 39 with their longitudinal axes spaced by a distance 40 (Fig. 6) from each other extending axially of the molding wheel 33. Each mold cavity 39 has a contour corresponding to the shape of the coupling element 2 as it is in a blank form before being bent into a U shape. The distance 40 determines an element-to-element distance or pitch 41 in a produced coupling element assembly.

The molding wheel 33 also has on its periphery 37 a pair of parallel annular grooves 42,43 (FIG. 6) intersecting the end portions of each of the elongate mold cavities 39. Each of the annular grooves 42,43 has a cross-sectional shape which is substantially the same as that of one of the warp-knit elongate webs 17,18. When the warp-knit elongate webs 17,18 are received in the annular grooves 42,43, respectively, the webs 17,18 have their upper surfaces held substantially flush with or lower than the periphery 37 of the molding wheel 33.

The injection shoe 36 has a segmental shape having an arcuate lower surface 44 facing the molding wheel 33. The injection shoe 36 is normally urged in a direction to cause the arcuate lower surface 44 to contact slidably with the periphery 37 of the molding wheel 33 by means of a spring 45 acting between the injection shoe 36 and a portion 46 of the frame.

Figure 7:
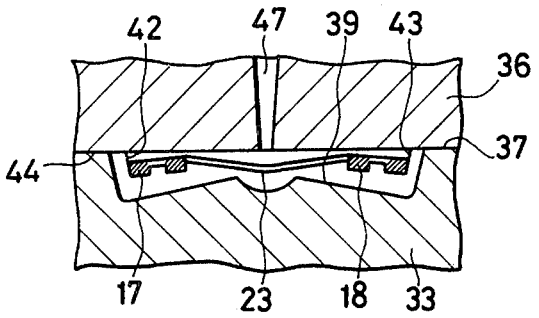
FIG. 7 is an enlarged longitudinal cross-section of a mold cavity.

The injection shoe 36 has a passageway or sprue 47 opening toward the molding wheel 33. The sprue 47 is located centrally lengthwise of the mold cavities 39, as shown in FIG. 7. Molten synthetic resin is forced from a heating chamber 48 into the sprue 47.

Figure 8:
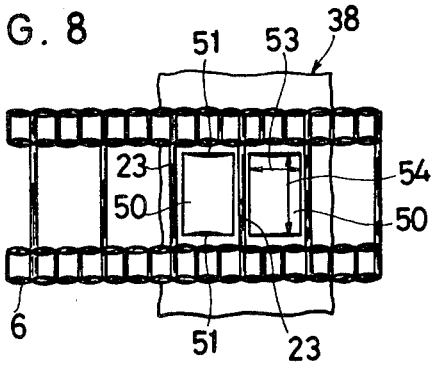
FIG. 8 is an enlarged fragmentary plan view of a guide drum.
Figure 9:
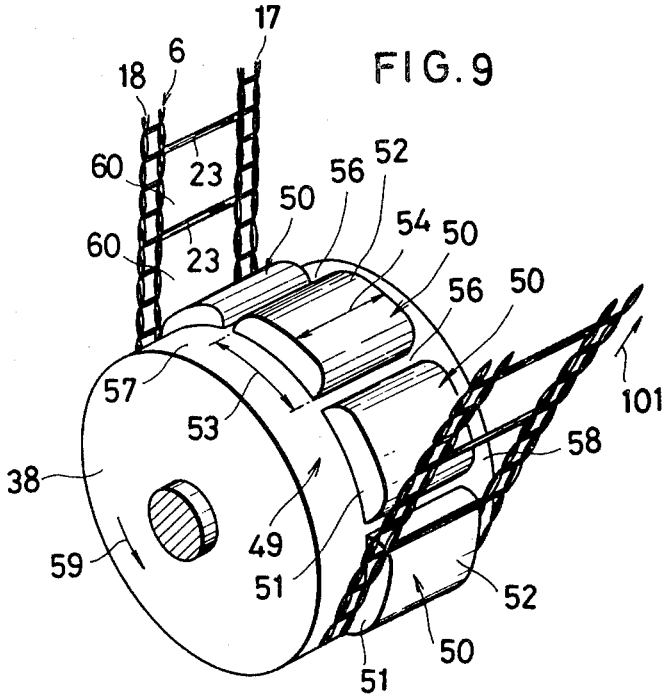
FIG. 9 is a perspective view, on an enlarged scale, of a guide drum.

As better shown in FIGS. 8 and 9, the guide drum 38 has on its periphery 49 a plurality of substantially rectangular raised portions 50 spaced circumferentially from each other. Each of the raised portions 50 is defined by a pair of radial sidewalls 51,51 spaced axially from each other and a substantially semi-cylindrical surface 52 extending between the sidewalls 51,51. Each raised portion 50 has a width 53, or a length of each sidewall, which is substantially the same as the distance 40 between the longitudinal axes of the mold cavities 39, and has a length 54, or a distance between the sidewalls 51,51 of each raised portion 50, which is substantially the same as a distance 55 between the annular grooves 42,43 on the molding wheel 33.

A plurality of axial channels 56 are each disposed between adjacent two of the raised portions 50. The axial channels 56 are spaced circumferentially from each other by the distance 40 between the longitudinal axes of the mold cavities 39.

The periphery 40 of the guide drum 38 includes a pair of annular surfaces 57,58 located one on each side of the series of the raised portions 50.

The guide drum 38 rotates about its own axis in the direction of the arrow 59 (FIG. 5) to feed the warp-knit elongate structure 6 in the direction of the arrow 101 onto the periphery 37 of the molding wheel 33 being rotated. The warp-knit elongate structure 6 while it is being longitudinally tensioned is positively fed by the guide drum 38 because the transverse thread portions 23 become placed one after another in the channels 56, and engaged by adjacent raised portions 50. While the warp-knit elongate structure 6 is being driven around and by the guide drum 38, the shape of the warp-knit elongate structure 6 is rectified or corrected into a predetermined ladder-like configuration.

More specifically, the rectangular raised portions 50 enter successively into a series of openings 60 each defined between adjacent two of the transverse thread portions 23 of the warp-knit elongate structure 6. The openings 60, or the surrounding thread portions, are forcibly contoured into the rectangular shape of the raised portions 50 by the sidewalls 51,51 and the channels 56. Accordingly, the warp-knit elongate structure 6 as it leaves the guide drum 38 has the transverse thread portions 23 spaced from each other more accurately by the distance 53 and the warp-knit webs 17,18 spaced from each other more accurately by the distance 54.

Figure 6:
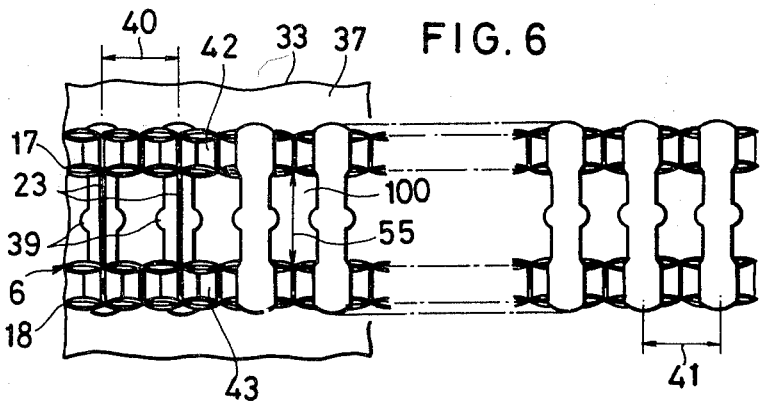
FIG. 6 is an enlarged fragmentary plan view of a molding wheel.

The warp-knit elongate structure 6 is then introduced between the injection shoe 36 and the molding wheel 33 while it is being rotated about its own axis. The warp-knit webs 17,18 are placed in the annular grooves 42,43, respectively, on the molding wheel 33, and the transverse thread portions 23 are located centrally in the mold cavities, as shown in FIGS. 6 and 7.

Molten synthetic resin is forced from the heating chamber through the sprue 47 into one of the mold cavities 39 which is positioned just beneath the sprue 47 and is supplied with the webs 17,18 and one of the transverse thread portions 23. The synthetic resin is then molded in said one of the mold cavities 39 around the webs 17,18 and said one of the transverse thread portions 23, thereby producing one of the coupling elements 2.

Since the sprue 47 is located at the center of the length of the mold cavities 39, the molten synthetic resin, when injected into the mold cavity 39, displaces a central portion of the transverse thread portion 23 downwardly. Such displaced thread portion assists in making a more secure union between the coupling element material and the transverse thread portion 23.

Figure 12:
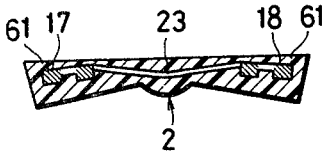
FIG. 12 is an enlarged longitudinal cross-secion view of a coupling element assembly.
Figure 13:
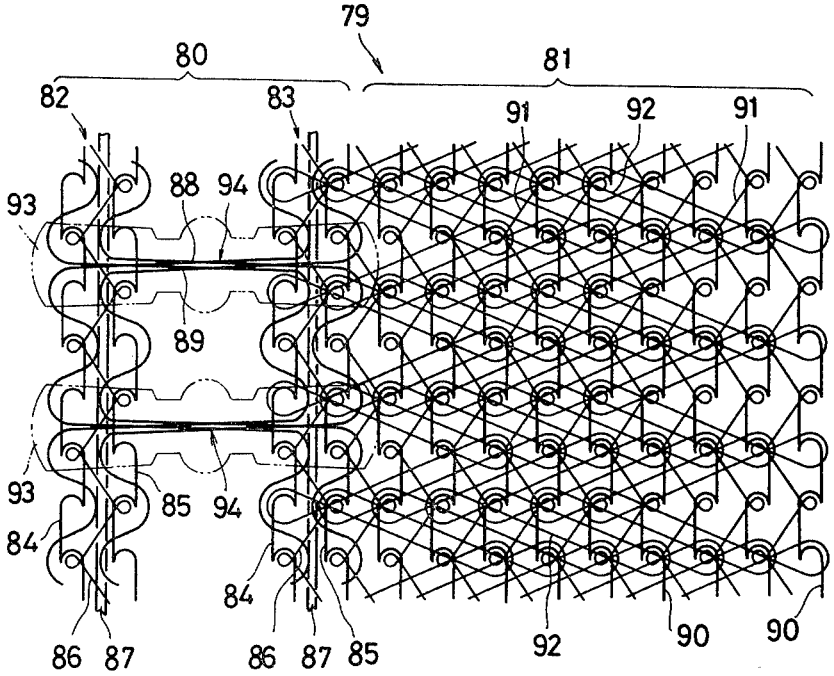
FIG. 13 is a point diagram for a warp-knit slide fastener stringer.
Figure 14:
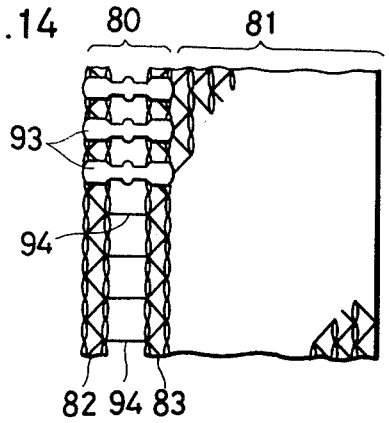
FIG. 14 is a fragmentary plan view of the warp-knit slide fastener stringer of FIG. 13.
Figure 15:
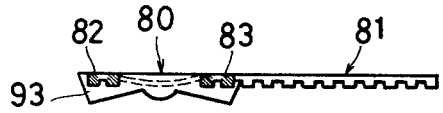
FIG. 15 is an enlarged end elevation view of the warp-knit slide fastener stringer of FIG. 13.

When the annular grooves 42,43 have a deeper bottom such that the warp-knit webs 17,18 have their upper surfaces located below the periphery 37 of the molding wheel 33, a layer 61 of synthetic resin is formed on each of the upper surfaces of the warp-knit webs 17,18, as shown in FIG. 12. the synthetic resin layers 61 become bonded together when the coupling element assembly is bent into a U shape with the layers 61 are fused together.

Continued rotation of the molding wheel 31 enables the mold cavity 39 filled with the molten synthetic resin to move past the sprue 47. A portion 100 (FIG. 6) of the periphery 37 of the molding wheel 33 which is disposed between the filled mold cavity 39 and the following mold cavity 39 comes under the sprue 47 and blocks the flow of the molten synthetic resin. As the molding wheel 33 rotates further, the next mold cavity 39 underlies the sprue 47, whereupon the molten synthetic resin is allowed to flow out of the sprue 47 into the mold cavity 39. The molding of the coupling elements 2 is thus repeated.

As shown in FIG. 5, a roller 62 is rotatably disposed adjacent to the molding wheel 33 downstream of the injection shoe 36. The coupling elements 2 as they are molded around the warp-knit structure 6 are separated from the mold cavities and transported around the roller 62. The coupling element assembly 1 is then supplied into a bending device 63 in which the coupling element assembly 1 is bent about its own longitudinal axis into the shape of a U ready for attachment to a stringer tape.

Figure 11:
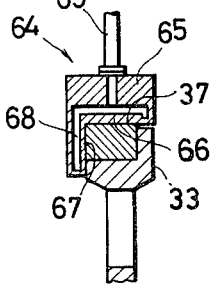
FIG. 11 is an enlarged transverse cross-section view of a cooling device.

The molding apparatus 32 additionally includes a cooling device 64 (FIGS. 5 and 11) having a jacket 65 with a pair of jacket walls 66,67 held in slidable contact with the periphery 37 and one of its sidewalls of the molding wheel 33. The jacket 65 includes a passageway 68 through which a coolant such as water flows to cool the mold cavities 39. The coolant is supplied from an inlet pipe 69 and discharged out of an outlet pipe 70, the pipes 69,70 being mounted on the jacket 65.

For cooling the molding wheel 33 effectively, the molding wheel 33 has a plurality of openings 71, and the axle 35 has a bore 72 for the passage therethrough of a coolant.

Figure 10:
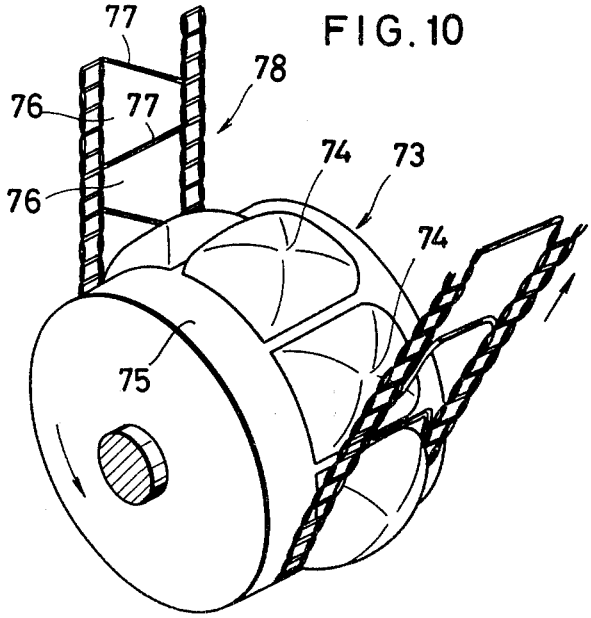
FIG. 10 is a view similar to FIG. 9, showing another embodiment of guide drum.

FIG. 10 illustrates an embodiment of guide drum 73 having a series of substantially rectangular raised portions 74 circumferentially spaced from each other on a periphery 75 of the guide drum 73. Each of the raised portions 74 is dome-shaped so that it can easily enter one of a plurality of openings 76 defined between transverse thread portions 77 of a warp-knit elongate structure 78 to be wound around and fed by the guide drum 73.

The guide drum 73 is advantageous particularly where the transverse thread portions 77 do not initially extend parallel to each other. The transverse thread portions 77 can be rectified by the dome-shaped raised portions 74 into a substantially parallel arrangement when they leave the guide drum 73.

FIGS. 13 through 16 show a warp-knit slide fastener stringer 79 that can be produced on the molding apparatus 32.

The slide fastener stringer 79 comprises a coupling element assembly 80 and a warp-knit stringer tape 81 interknitted therewith. The coupling element assembly 80 includes a pair of spaced warp-knit elongate webs 82,83 each comprising a pair of first threads 84,85 forming a pair of wales of chain stitches having a pattern of 1-0/0-1, a second thread 86 knitted with the first threads 84,85 in a pattern of 1-0/1-2, and a reinforcing warp thread 87 extending longitudinally between the first threads 84,85. The warp-knit elongate webs 82,83 are interconnected by a pair of sets of third threads 88,89 interlaced with the webs 82,83 in opposite symmetrical patterns of 5-5/4-4/5-5/0-0/1-1/0-0 and 0-0/1-1/0-0/5-5/4-4/5-5.

The stringer tape 81 comprises a plurality of fourth threads 90 forming a plurality of wales of chain stitches having a pattern of 1-0/0-1, a plurality of fifth threads 91 knitted with the fourth threads 90 in a pattern of 1-0/1-2, and a plurality of sixth threads 92 knitted with the wales in a pattern of 1-0/4-5.

The coupling element assembly 80 and the stringer tape 81 are interconnected by one of the fifth threads 91 and a pair of the sixth threads 92. A row of coupling elements 93 is molded around transverse parallel portions 94 of the third threads 88,89 interconnecting the warp-knit elongate webs 82,83 and around longitudinally spaced portions of the warp-knit elongate webs 82,83.

Figure 16:
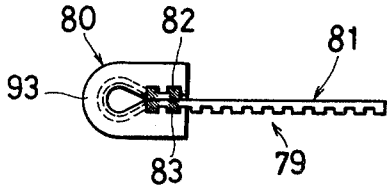
FIG. 16 is an end elevation view of the warp-knit slide fastener stringer of FIG. 15 with its coupling element assembly folded on itself into the shape of a U.

As best shown in FIG. 16, the formed coupling element assembly 80 is bent about its longitudinal axis into the shape of U, thereby finalizing the manufacture of the slide fastener stringer 79.

Although preferred embodiments have been shown and described in detail, it should be understood that various changes and modifications can be made therein without departing from the scope of the appended claims.

I claim

1. An apparatus for producing a coupling element assembly for slide fasteners which includes a row of spaced coupling elements of synthetic resin and a warp-knit elongate structure having a pair of spaced webs and a plurality of transverse thread portions interconnecting the spaced webs and embedded in the coupling elements, said apparatus comprising:

a rotatable molding wheel having on its periphery a series of elongate mold cavities with their longitudinal axes spaced by a distance from each other extending axially of said molding wheel for receiving the transverse thread portions, and a pair of parallel annular grooves intersecting end portions of each of said mold cavities for receiving the spaced webs;

an injection shoe fixedly disposed in slidable contact with a portion of the periphery of said molding wheel and having a sprue opening toward said periphery portion of the molding wheel;

a guide drum rotatably disposed adjacent to said molding wheel on one side of said injection shoe for guiding the warp-knit elongate structure onto said molding wheel, said guide drum having on its periphery a series of substantially rectangular raised portions spaced circumferentially from each other with axial channels therebetween spaced from each other by said distance, each of said raised portions having a width which is substantially the same as said distance and a length which is substantially the same as a distance between the annular grooves;

means disposed adjacent to said molding wheel on a side opposite said one side of said injection shoe for separating a molded product from one of said mold cavities at a time; and means disposed adjacent to said separating means for bending the molded product about its transverse central axis into the shape of a U.

2. An apparatus for producing a coupling element assembly for slide fasteners according to claim 1, including means disposed between said injection shoe and said separating means for forcibly cooling the molded product.

* * * * *